US005533860A

United States Patent [19]

Gämmerler

[11] Patent Number: 5,533,860

[45] Date of Patent: Jul. 9, 1996

[54] ROTATABLE STACKING CHAMBER IN A RIGHT-ANGLE FEEDER FOR PRINTED PRODUCTS

[76] Inventor: Hagen Gämmerler, D-82057 Icking, Ichoring 44, Germany

[21] Appl. No.: 294,985

[22] Filed: Aug. 24, 1994

[30] Foreign Application Priority Data

Aug. 25, 1993 [DE] Germany ..... 43 28 604.6

[51] Int. Cl.[6] ..... B65H 31/34; B65H 31/24; B65H 31/20

[52] U.S. Cl. ..... 414/789; 414/907

[58] Field of Search ..... 414/788.3, 789, 414/791.2, 900, 907

[56] References Cited

U.S. PATENT DOCUMENTS

| | | | |
|---|---|---|---|
| 3,090,503 | 5/1963 | Curtenius | 414/900 |
| 3,595,370 | 7/1971 | Fujishiro . | |
| 4,183,704 | 1/1980 | Steinhart | 414/788.3 |
| 4,657,465 | 4/1987 | Aoki | 414/907 |
| 4,725,180 | 2/1988 | Kasamatsu et al. | 414/788.3 |
| 5,312,223 | 5/1994 | Kleinhen | 414/788.3 |
| 5,353,576 | 10/1994 | Palamides et al. | 414/791.2 |
| 5,387,077 | 2/1995 | Yatsuka et al. | 414/907 |
| 5,392,700 | 2/1995 | Kleinhen | 414/791.2 |

FOREIGN PATENT DOCUMENTS

| | | | |
|---|---|---|---|
| 7406826 | 2/1974 | Germany . | |
| 3839304 | 5/1990 | Germany . | |
| 0243764 | 10/1986 | Japan | 414/791.2 |
| 647735 | 2/1985 | Switzerland . | |

*Primary Examiner*—Karen B. Merritt
*Assistant Examiner*—Douglas Hess
*Attorney, Agent, or Firm*—Palmatier, Sjoquist & Helget

[57] ABSTRACT

A rotatable stacking chamber (1) is defined for a right-angle feeder for printed products in which the longitudinal and transverse walls (3,4) are adjustable with respect to the chamber dimensions via a controllable actuator (5, 5') assignable in each case.

11 Claims, 6 Drawing Sheets

ROTATABLE STACKING CHAMBER IN A RIGHT-ANGLE FEEDER FOR PRINTED PRODUCTS

TECHNICAL FIELD

The present invention relates to a rotatable stacking chamber in a right-angle feeder for printed products comprising a stacking table capable of being lifted and rotated, each of the chamber walls being formed by two longitudinal and transverse walls opposing each other and at least one of two each of the opposing walls being shiftable as regards the opposing wall for the purpose of adjusting the size of the printed products and at least one of the walls being removable for the purpose of discharging the printed products stacked in the chamber.

BACKGROUND OF THE INVENTION

Such rotatable stacking chambers are incorporated in a conveyor link for printed products for stacking a certain number of the products in each case. Since the printed products are often folded on one side the height of the leading edge is different to that of the trailing edge. This is compensated for by the stack being turned thru 180° when half of the desired height is attained, so that the subsequent half of the printed products is located with its folded edge on the side locating the leading edge of the lower half of the stack.

To achieve precise alignment of the stack it is necessary to subsequently adjust the side walls of the stacking chambers since the initial adjustments—for instance for standard product sizes—may possible prove to be too small or too large. In case the dimensions are too large the layers of printed products materialize staggered, if the dimensions are too small the printed products remain in the chamber partly skew and become dog-eared.

From prior art it is known to maintain the side walls of stacking chambers slidable on guides, subsequent millimeter adjustments to the size of the stacking chamber being implemented by locating means for manual actuation and by means of a linear rule. This work is highly tedious since it requires tapping the corresponding walls into place by means of a plastic hammer. Although the chamber becomes smaller for a small print format, the linear rule projects from the chamber wall, since it remains stationary. Arresting the side walls also needs to be executed very tightly, so that the setting does not loosen during operation, on the other hand, however, the setting must be releasable with sufficient ease without necessitating an additional tool to release the fastening. For this reason the locking means are usually provided with a hand lever which, in turn, must not be so large as to interfere with the cramped arrangement of the right-angle feeder.

For the aforementioned reasons, correctly setting the dimensions of the chamber is often highly time-consuming and, on top of this, can only be done with production halted.

SUMMARY OF THE INVENTION

The invention is thus based on the object of defining a rotatable stacking chamber in the cited field which by a simple and moderate cost structure permits adapting and fine adjustment to the printed products during operation.

This object is achieved according to the invention in that at least one longitudinal wall and at least one transverse wall is adjustable via a controllable actuator means assignable to each.

By these means an adjustment of the stacking chamber may be implemented during on-going production without interrupting the flow of printed products.

It may be of advantage in this respect that the means for actuating at least one adjustable transverse wall are arranged on one or both of the longitudinal walls.

An actuator motor may be arranged in the middle of the longitudinal wall which via a gear drive powers two spindles, each of which shifts the transverse wall or a part of the transverse wall. Arranging the complete actuator means on the longitudinal wall permits facilitated installation and maintenance.

By configuring the actuator means with an actuator motor which via a gear drive powers at least one spindle for moving the transverse wall it is possible to implement highly precise shifting in position.

To provide such a precise means of adjustment it may be of advantage that the gear drive features a worm gear toothing separately for each transverse wall, the output worm gearwheel being provided with a female thread which coacts with the spindle which is rotatably held on the assigned transverse wall or the corresponding part of the transverse wall.

A worm gear toothing having a spindle running in a female thread of an output worm gearwheel offers the advantage of a highly self-retarding effect which counteracts any adjustment of the transverse wall by itself or of the assigned part of the transverse wall.

It may be of advantage in configuring an adjustable stacking chamber to arrange for the transverse wall or part of the transverse wall in each case to be held on guide rods which slide in the mountings provided on the corresponding longitudinal wall. By means of these features no-problem shifting of the transverse wall or a part thereof is rendered possible without the risk of jamming.

A further advantageous feature is to be appreciated in that at least one of the transverse walls features two side swivel doors capable of being swivelled outwards which can be power operated. Both of the transverse walls are configured in this two-part arrangement so that discharge of a complete stack may be implemented irrespective of the rotary position, due to the transverse wall facing the discharge station in each case permiting discharge of the complete stack by the swivel doors being swivelled outwardly.

In the case of a stacking chamber having a press means for compacting the stacked printed products, whereby the press means feature a press rail secured to a swivel arm, it may be of particular advantage to configure the swivel arm substantially C-shaped to clasp the arrangement of the actuator means from without. One such swivel arm may thus be easily swivelled over the product stack without coming into conflict with other component parts.

One substantial feature of the invention involves the two longitudinal walls being shiftably held on the turntable, it being favorable in this respect to arrange the actuator means in or beneath the table plate of the stacking table for at least one shiftable longitudinal wall. Of particular advantage is to arrange for both opposing longitudinal walls to be shiftable via a common actuator means, it being favorable to provide the actuator means with an actuator motor for driving the drive shaft of the two longitudinal walls. In a favorable arrangement a toothed disk is defined on each drive shaft for each longitudinal wall which drives an adjuster spindle via a ribbed belt, this adjuster spindle moving a connecting link nut fixedly attached to the longitudinal wall. In this embodiment it is favorable to guide the side wall in a linear guide. This linear guide features two guide members arranged in parallel, between which the adjuster spindle is arranged.

In yet another embodiment it may be favorable for the actuator means for the longitudinal walls to feature a pneumatic or hydraulic cylinder-piston assembly and, where necessary, a gear unit.

In one variant of the aforementioned actuator means the actuator motor may be arranged on the side wall which it drives via a toothed rod fixedly attached to the stacking table with a gear drive means being interposed.

The invention will now be explained in more detail on the basis of the example embodiments shown in the drawings.

DETAILED DESCRIPTION

Figure 1:
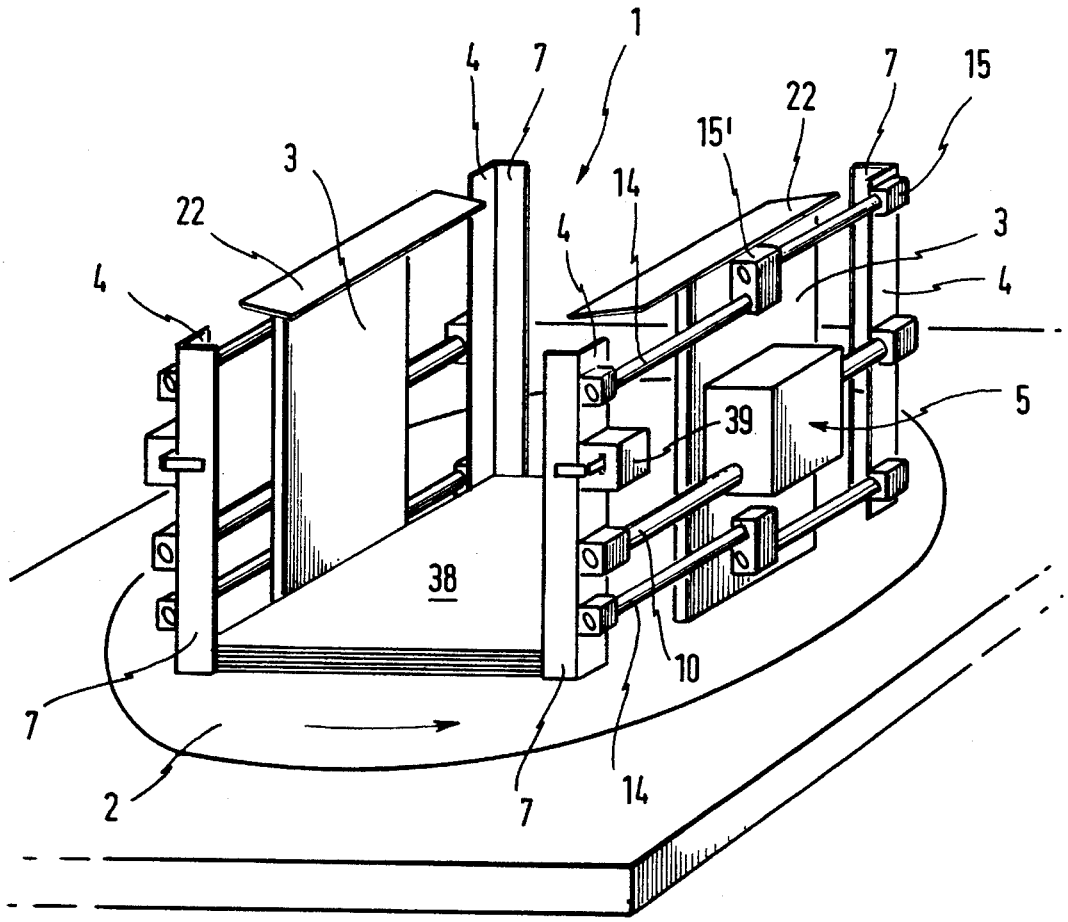
FIG. 1 is a schematic representation of a stacking chamber according to the invention shown in perspective.

Turning now to the drawings, FIG. 1 illustrates the schematic arrangement of a stacking chamber 1 of a right-angled feeder shown in perspective. The stacking chamber is provided with a rotatable stacking table 2 as well as longitudinal walls 3 and transverse walls 4. In the illustrated embodiment each of the transverse walls 4 comprises two swivel doors 7 with a space inbetween through which a discharge means (not shown) is able to discharge a stack of printed products when the opposing transverse wall is open. (For better clarity an incomplete stack of printed products 38 is depicted in FIG. 1). When the stack is complete, the swivel doors are opened out at the discharge end by means of a pneumatic piston-cylinder assembly 39 in the example embodiment shown.

To compensate for an uneven stack height where folded printed products are concerned, the stacking chamber is swivelled several times when necessary, at least once, however, thru 180° to fill up the stack. This swivel movement results in the transverse wall—which was swivelled out during the previous discharge procedure—assuming the position of the rear transverse wall in the subsequent stacking procedure, so that both transverse walls are each configured with swivel doors.

In FIG. 1 reference numeral 5 identifies an actuator means, represented here schematically, which is able to vary the spacing of the transverse walls from each other.

Figure 2:
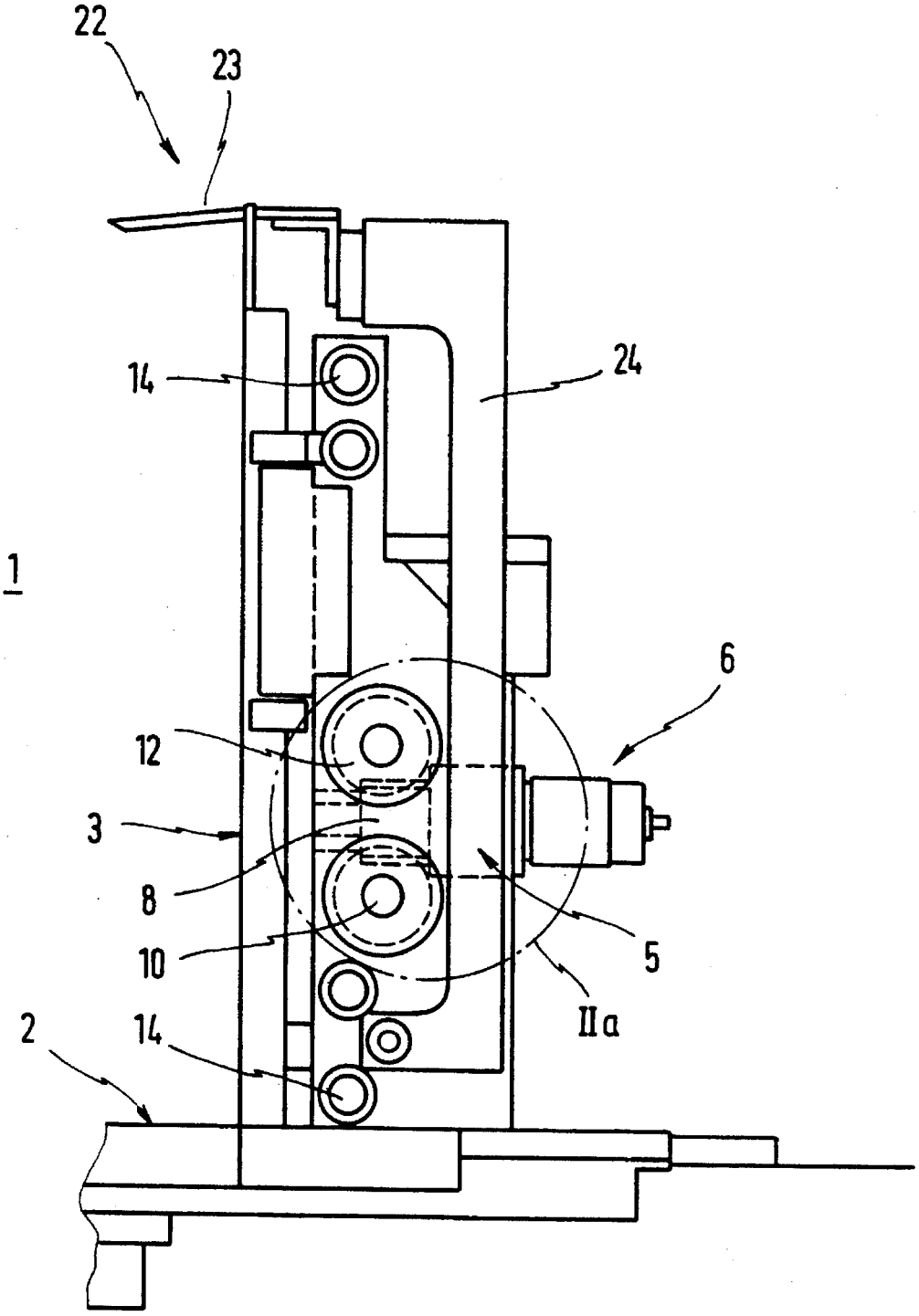
FIG. 2 is a side view on a longitudinal wall with a press means and a controllable actuator means.
Figure 2A:
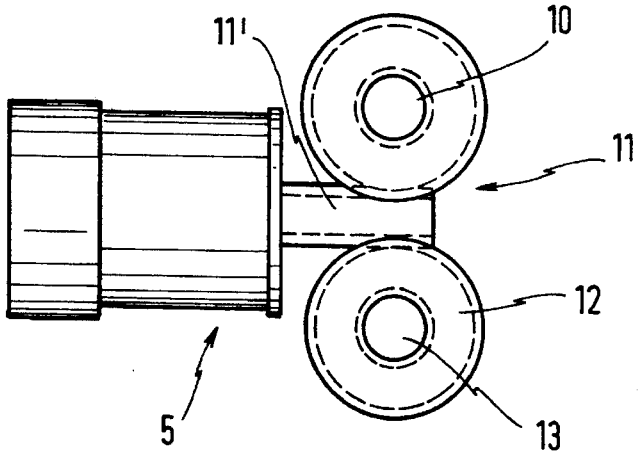
FIG. 2*a* is an illustration of detail IIa in FIG. 2 showing the actuator motor/worm gear toothing assembly.

FIG. 2 shows a side view of a longitudinal wall 3 of the stacking chamber 1 with part of the stacking table 2. The longitudinal wall 3 carries on its outside the actuator means 5, comprising a gear drive 8 as well as two spindles 10 powered by the gear drive. In the example embodiment shown an actuator motor 6 is provided which via a worm gear toothing (viz. FIG. 2*a*) drives two output worm gearwheels 12, each of which is arranged rotatably connected to the motor shaft of the actuator motor 6. The output worm gearwheels 12 are provided with a female thread 13 which coacts with each of the assigned spindles 10. The one spindle is connected to a part of a front transverse wall and the other to a part of a rear transverse wall. Each of the ends of the spindle 10 facing away from the output worm gearwheel 12 is rotatably held in the corresponding part of the transverse wall so that a rotation of the spindles 10 produces a movement of the part of the transverse wall.

To ensure reliable guidance of the parts of the transverse wall in each case, the parts of the transverse wall 4 are each guided by means of guide rods 14. On the one hand, these guide rods 14 are fixedly attached in bearings 15 on the corresponding parts of the transverse walls 4, whilst on the other, they are shiftably mounted in bearings 15' on the longitudinal wall.

The longitudinal wall is provided with a press means 22 for compacting the stack of printed products. For this purpose a pressing rail 23 is provided at the upper edge of the side wall 3. The pressing rail 23 is secured to a swivel arm 24 which is substantially C-shaped and clasps the arrangement of the actuator means 5 from without. For adjusting the stacking chamber to the dimensions of the printed products in the embodiment illustrated, both longitudinal walls 3 are held shiftably on the rotatable stacking table 2.

Figure 3:
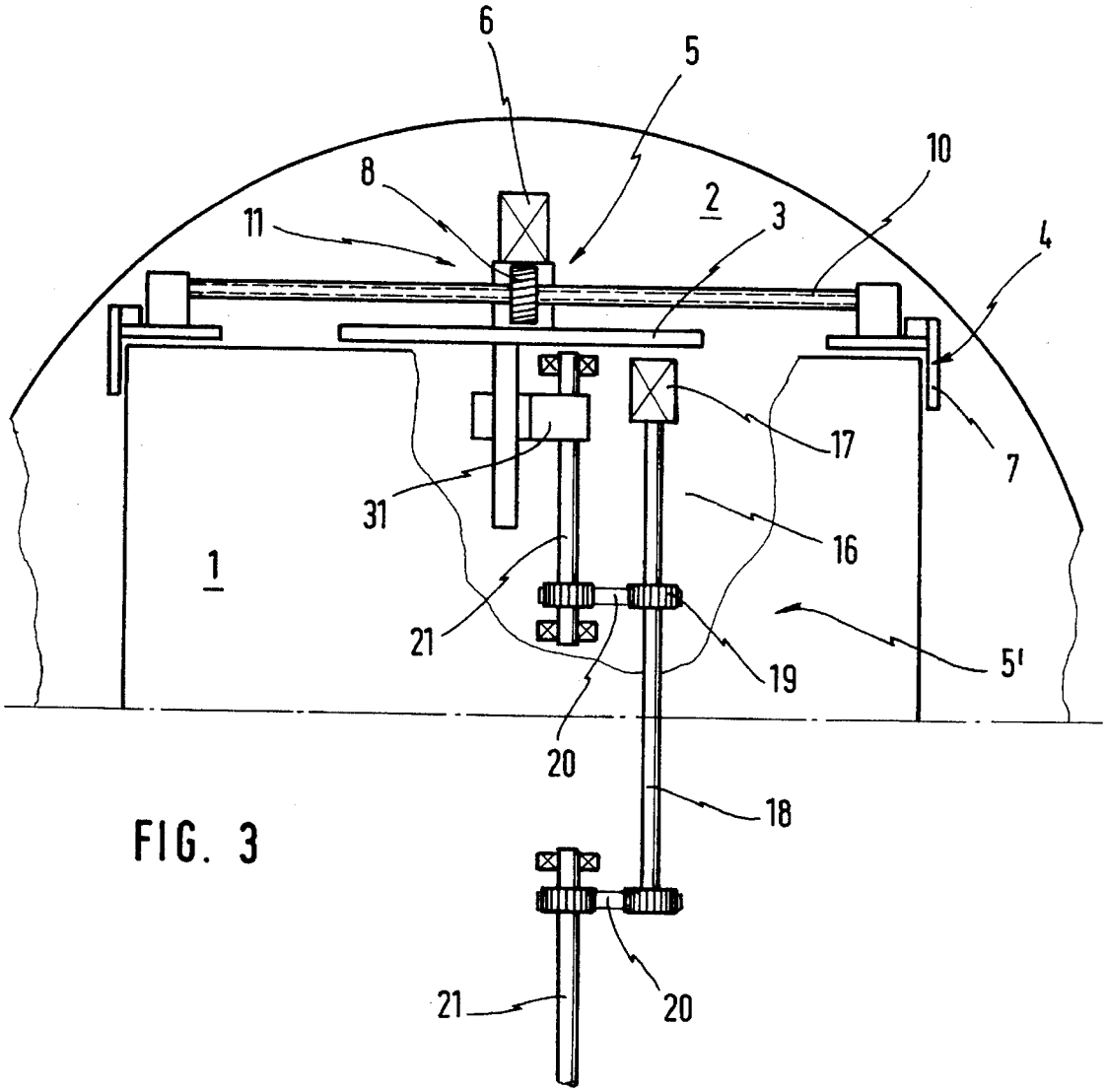
FIG. 3 is a partial view of the stacking chamber as viewed from above with broken out areas.

FIG. 3 shows a plan view of a schematic illustration of the actuator means 5' for the longitudinal walls 3 with areas of the stacking table 2 shown partly broken out.

Figure 4:
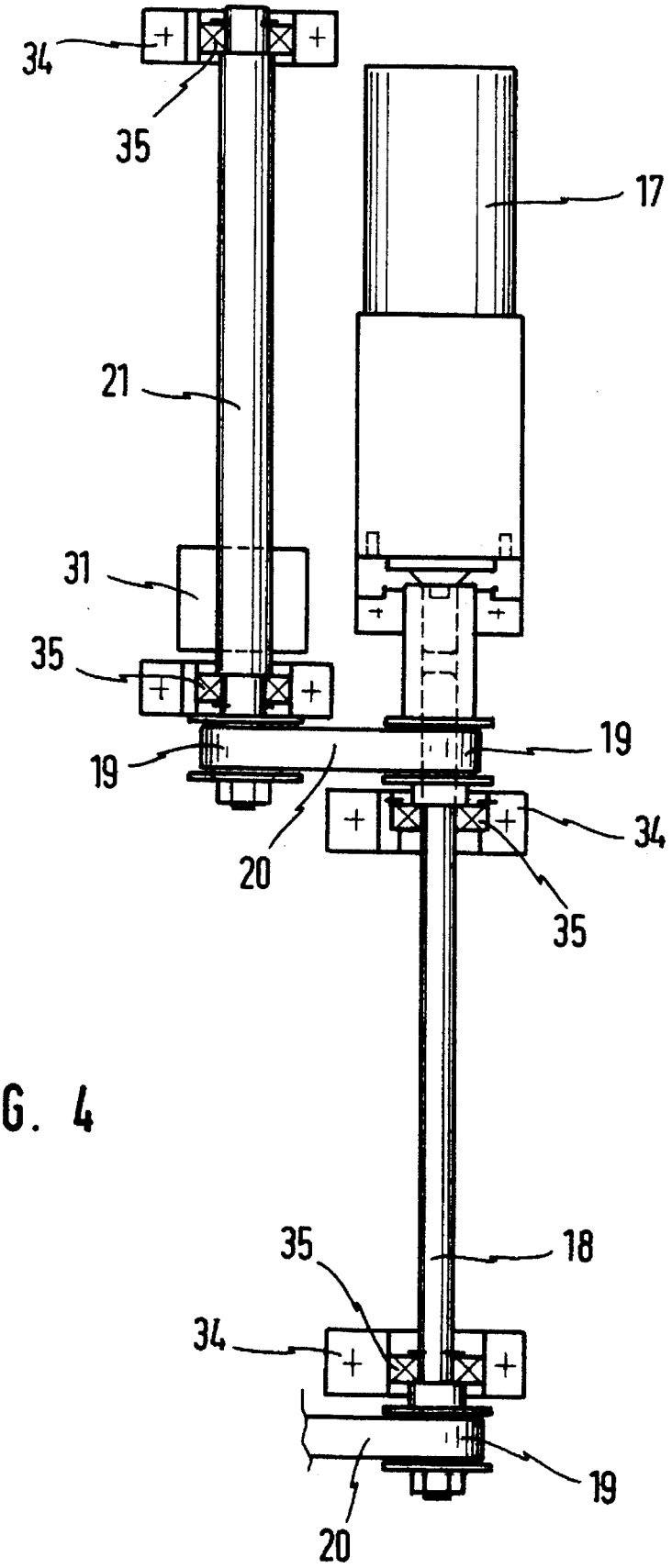
FIG. 4 is a detail view of a broken out area in the stacking table with actuator means for the longitduinal walls.

The actuator means 5' for shifting both longitudinal walls as provided for in the example embodiment shown is arranged in or beneath the table plate 9 of the stacking table 2. In the example embodiment shown in FIGS. 3 and 4 both opposed longitudinal walls 3 are shiftable via a common actuator means 5'. The actuator means 5' has an actuator motor 6 which powers a drive shaft 18 for both longitudinal walls 3. The drive shaft 18 which extends substantially perpendicular to the longitudinal wall 3 has a length extending beyond the axis of symmetry between the two longitudinal walls. On the drive shaft 18 two toothed disks 19 are each defined separately one longitudinal wall 3. Each of the toothed disks 19 which in the example embodiment shown are each symmetrically spaced on both sides of the axis of symmetry on the drive shaft 18 drives via a ribbed belt 20 an actuator spindle 21, each of which moves a connecting link nut 31 fixedly connected to a longitudinal wall 3. The actuator spindles have opposing pitches so that symmetrical adjustment of the longitudinal walls is possible.

To ensure a precisely parallel position of the longitudinal walls 3 each of the longitudinal walls is assigned a linear guide 25 which may comprise a guide rail. Such linear guide means are known. Each of the actuator spindles 21 is end mounted in bearing brackets 34 by means of ball bearings 35. A similar bearing arrangement is provided for the drive shaft 18 which is driven by the second actuator motor 17.

Figure 5:
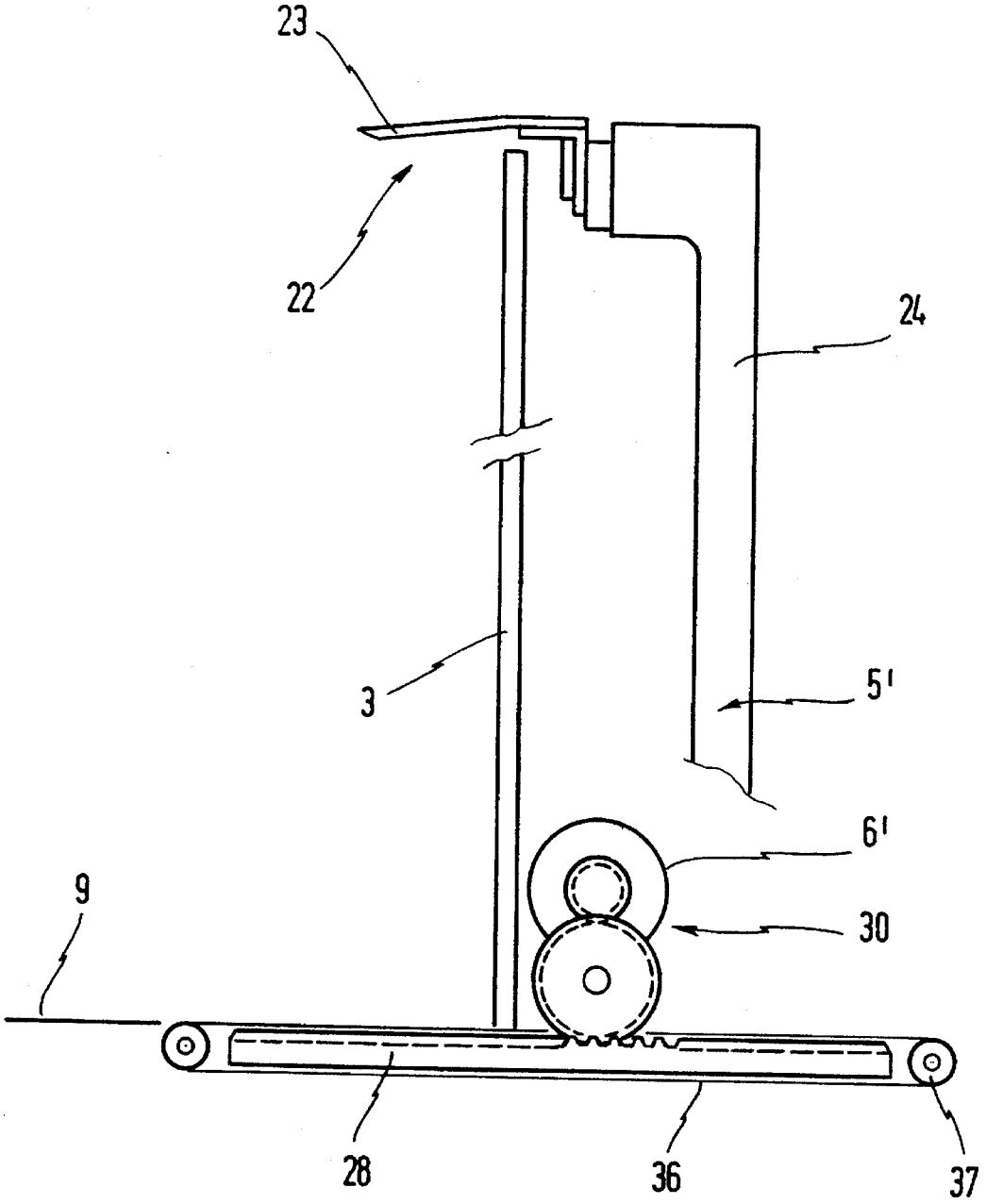
FIG. 5 is a side view of a schematic representation of an actuator means with gear-toothed rack and cover band fixedly attached to the stacking table.

FIG. 5 depicts an alternative embodiment of the actuator means 5' for a longitudinal wall. In this embodiment the drive motor is located in the lower region of the longitudinal wall 3 and drives the longitudinal wall via a gear ratio divider 30 which coacts with a gear-toothed rack 28 fixedly attached in the turntable. The gear-toothed rack 28 may be arranged in the stacking table 2 so that the flat end surfaces of the gear-toothed rack locate in a plane with the surface of the table plate 9. Depending on the quality of the paper undesirable pressure marks may result on the bottomost printed product when it is pressed on the table plate 9. To prevent this happening a highly flexible cover band 36 is provided, secured to the longitudinal wall 3 and guided over and wrapped around the deflector sheaves 37 arranged at both ends of the gear-toothed rack 29 defined in the table, the gear-toothed rack 29 being displaced downwards by the thickness of the cover band with respect to the surface of the table plate 9.

Figure 6:
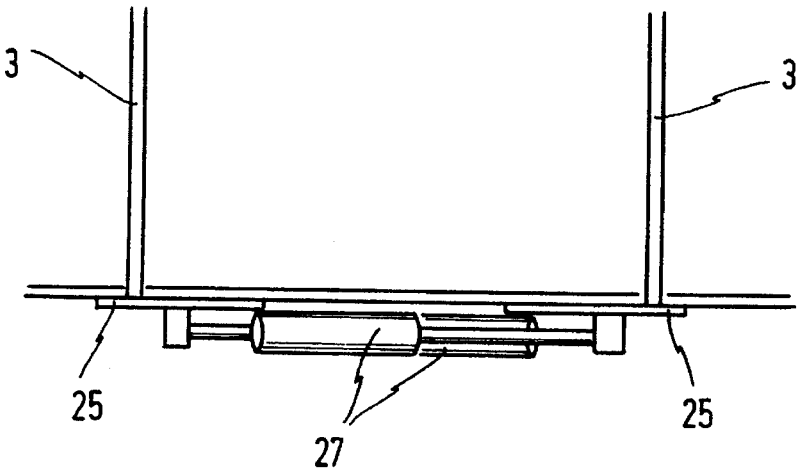
FIG. 6 is a further embodiment of the actuator means employing piston-cylinder units for each longitudinal wall shown in the side view.
Figure 7:
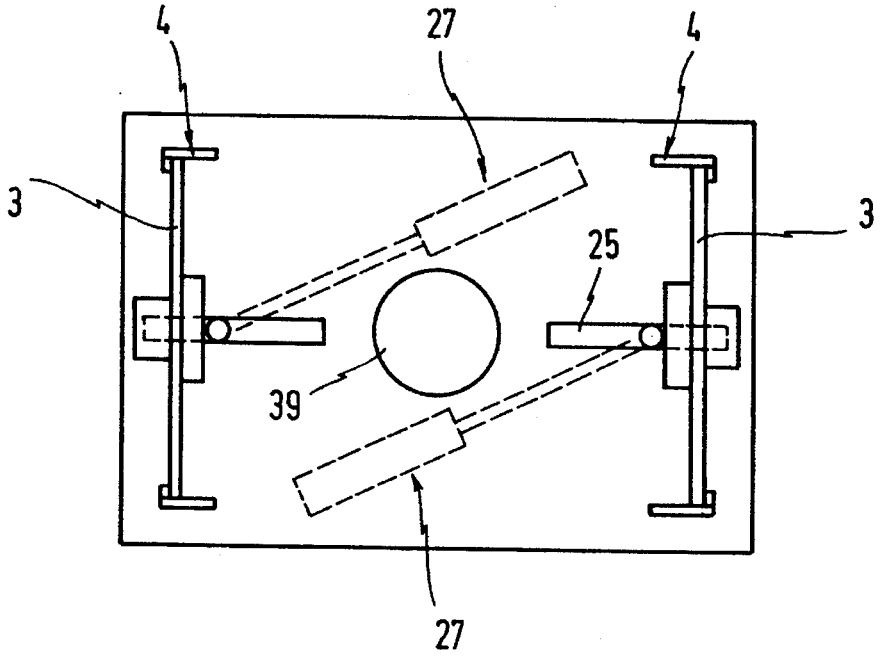
FIG. 7 is an illustration of the arrangement as per FIG. 6 as viewed from above.

In an alternative embodiment, which is illustrated in FIGS. 6 and 7, the actuator means involve two piston-cylinder assemblies 27.

In the example embodiment shown these piston-cylinder assemblies are arranged at an angle to the longitudinal walls 3 so as to leave a space inbetween for the reciprocating cylinder 39 of the stacking table.

The free end of the piston rod of the piston-cylinder assembly 27 is secured articulated to a downwards projecting spigot of the longitudinal wall. Here again in this embodiment linear guidance may be employed in the form of a guide rail.

In yet a further embodiment (not shown) instead of single-acting piston-cylinder assemblies, double-acting piston-cylinder assemblies may be provided with two diametrally opposed piston rods, each of which engage a longitudinal wall. For reasons of symmetry it is good practice to make use of two such double-acting cylinder assemblies, since this allows possible tilting problems in the guidance of the longitudinal walls 3 to be avoided.

By the achievement of the features according to the invention a stacking chamber is created which can be easily and quickly adjusted during on-going production and with which any transfer means needed may be brought up very close to the stacking chamber even in the case of small printing formats.

What is claimed is:

1. A rotatable stacking chamber for printed products, comprising:

a) a stacking table;

b) a pair of longitudinal facing walls on said stacking table, at least one of said walls being transversely movable relative to said table;

c) a pair of transverse facing walls on said stacking table, at least one of said walls being longitudinally movable relative to said table;

d) means for removing at least one of said longitudinal and transverse walls for discharging printed products stacked between said walls; and e) a controllable actuator means for moving said at least one of said longitudinal and transverse walls, said actuator means comprising an actuator motor and gear drive, and a spindle connected to said at least one of said transverse walls, said gear having teeth including a worm gear wheel which coacts with said spindle; said actuator motor being arranged in the middle of one of said longitudinal walls and being coupled to said spindle for moving said at least one transverse wall; whereby said longitudinal facing walls and said transverse facing walls form a stacking chamber.

2. The apparatus of claim 1, further comprising guide mountings on said longitudinal walls and guide rods affixed to said transverse walls, said guide rods being slidably received by said guide mountings.

3. The apparatus of claim 1, wherein said means for removing at least one of said longitudinal and transverse walls further comprises side swivel doors which may be pivoted outwardly to remove said at least one wall.

4. The apparatus of claim 1, further comprising a press means for compacting stacked products, said press means comprising a press rail secured to a C-shaped swivel arm.

5. A rotatable stacking chamber for printed products, comprising:

a) a stacking table;

b) a pair of longitudinal facing walls on said stacking table, both of said longitudinal facing walls being transversely movable relative to said table;

c) a pair of transverse facing walls on said stacking table, at least one of said walls being longitudinally movable relative to said table;

d) means for removing at least one of said longitudinal and transverse walls for discharging printed products stacked therebetween; and e) a controllable actuator means for moving said longitudinal walls and said at least one of said transverse walls, said actuator means being arranged on one of said longitudinal walls for moving said at least one transverse wall; the actuator means comprising an actuator motor arranged in the middle of one of said longitudinal walls, and a gear drive coupled to said motor, and a spindle connected to said gear drive and to said at least one movable transverse wall.

6. The apparatus of claim 5, wherein said gear drive further comprises a worm gear having a female thread coacting with said spindle.

7. The apparatus of claim 5, further comprising slide mountings on said longitudinal walls and guide rods affixed to said transverse wall, said guide rods being slidable into said slide mountings.

8. The apparatus of claim 5, wherein said means for removing at least one of said longitudinal and transverse walls further comprises swivel doors pivotally mounted to said longitudinal wall, said swivel doors forming said transverse wall and said means for removing.

9. The apparatus of claim 5, further comprising a press means for compacting stacked printed products, said press means comprising a press rail secured to a C-shaped swivel arm, said swivel arm connected to said table.

10. The apparatus of claim 5, wherein said actuator means further comprises an actuator motor coupled to a drive shaft, and said drive shaft connected to both longitudinal walls.

11. The apparatus of claim 10, further comprising a toothed disk on said drive shaft coupled to said longitudinal walls.

* * * * *